US005651550A

United States Patent [19]

LaVorgna et al.

[11] Patent Number: 5,651,550

[45] Date of Patent: Jul. 29, 1997

[54] BIODEGRADABLE EDIBLE TARGET

[75] Inventors: Blaise M. LaVorgna, Salisbury, Md.; Farron Eisemann, Riverton, Wyo.

[73] Assignee: Brainstorm Associates, LLC, Salisbury, Md.

[21] Appl. No.: 596,011

[22] Filed: Feb. 6, 1996

[51] Int. Cl.[6] ..... F41J 9/16

[52] U.S. Cl. ..... 273/363

[58] Field of Search ..... 273/362–366

[56] References Cited

U.S. PATENT DOCUMENTS

| | | | |
|---|---|---|---|
| 2,831,778 | 4/1958 | Allison et al. | 106/281 |
| 3,169,767 | 2/1965 | Bingham, Jr. | 273/105.4 |
| 3,376,040 | 4/1968 | Moehlman et al. | 273/105.4 |
| 3,399,255 | 8/1968 | Moehlman et al. | 264/117 |
| 3,572,714 | 3/1971 | Lau | 273/105.4 |
| 3,840,232 | 10/1974 | Ludwig et al. | 273/105.4 |
| 3,884,470 | 5/1975 | Paulson | 273/105.4 |
| 4,124,550 | 11/1978 | Kobayashi et al. | 260/23.3 |
| 4,568,087 | 2/1986 | Schreiner-Hansen | 273/362 |
| 4,623,150 | 11/1986 | Moehlman et al. | 273/362 |
| 5,174,581 | 12/1992 | Goodson | 273/363 |
| 5,316,313 | 5/1994 | Moore | 273/363 |
| 5,467,998 | 11/1995 | Hellings | 273/363 |

*Primary Examiner*—Mark S. Graham
*Attorney, Agent, or Firm*—Wenderoth, Lind & Ponack

[57] ABSTRACT

A biodegradable edible target is provided which is mainly composed of a plant which is an edible ground forage for an animal, or a portion or derivative of the plant.

9 Claims, No Drawings

BIODEGRADABLE EDIBLE TARGET

BACKGROUND OF THE INVENTION

1. Field of the Invention

This invention is directed to an improved target for shooting sports such as trap and skeet shooting.

More particularly, the invention is directed to a composition for a shooting target which comprises a body which is mainly composed of a plant that is an edible ground forage for an animal, or a portion or derivative of the plant. The target is not only biodegradable and non-toxic to animals, but it is also edible by animals as forage.

2. Description of Related Art

There are many known compositions for shooting targets. The most commonly used target compositions consist essentially of pitch and limestone or clay. For example, see U.S. Pat. Nos. 2,831,778; 3,169,767; 3,399,255; 3,376,040; and 3,572,714. Such targets have the disadvantage that they are toxic to certain animals such as hogs and the disadvantage that they are non-degradable or degrade very slowly.

In an effort to make targets that are environmentally degradable and non-toxic to animals, a variety of target compositions have been developed. One target composition uses sulfur in the place of pitch to bind the conventional component of a limestone or clay filler. See U.S. Pat. No. 3,840,232. Another target composition contains essentially only sulfur and minor additives. See U.S. Pat. No. 3,884,470. A target composition containing a low molecular weight thermoplastic resin, a high molecular weight thermoplastic resin and inorganic filler is taught in U.S. Pat. No. 4,124,550. A target composition consisting essentially of plaster, water, calcium carbonate and spar is taught in U.S. Pat. No. 4,568,087. Another target composition consisting of 85–96% inert filler such as limestone, gypsum, anthracite or sand and the remainder being an organic or inorganic binder such as starch, cellulose materials, resin, and the like is taught in U.S. Pat. No. 4,623,150.

None of the prior target compositions contain as a main component a plant, or a portion or derivative thereof. Further, there is not disclosed or suggested in the prior art forming a target from a plant, or a portion or derivative thereof, which is an edible ground forage for an animal. Thus, the present invention is the first target composition of its kind which is not only biodegradable and non-toxic to animals but is also edible by animals as forage.

SUMMARY OF THE INVENTION

The present invention is directed to a target comprising a target body which is mainly composed of a plant which is an edible ground forage for an animal, or a portion or derivative of said plant. More particularly, the target is mainly composed of a ground forage plant of the grass family or legume family or mixtures thereof. Examples of suitable grass plants include wheat, corn, oats, rye, barley, rice and the like. Examples of suitable legume plants include alfalfa, beans, clovers, peas, peanuts and the like.

The target may be mainly composed of the entire plant, or a portion or derivative of one or more of such plants. For example, the portion or derivative of such plant may be left over from a commercial process after removal of the commercially valuable portion of the plant. Plant portions or derivatives such as soybean hulls, rice hulls, ground corn cob, wheat and corn bran, meals, etc. are inexpensive and suitable for use in the present invention.

DETAILED DESCRIPTION OF THE INVENTION

The plant used in this invention may be any edible ground forage. Ground forage plants are well defined in the art. For example, see Arthur E. Cullison, Feeds and Feeding, Reston Publishing Company, (1975); H. D. Huges et al. (eds.), Forages, (1951); and C. V. Piper, Forage Plants and their Culture, rev. ed. (1924).

Preferably, the plant is a member of the legume family or grass family. Any plant of the legume family may be used in this invention, particularly those legumes which are commonly used for grazing, hay and silage. The principal cultivated legume forages which are suitable for use in this invention are clovers, particularly white, red, crimson and alsike clovers; alfalfa; lespedezas; vetches; peas, particularly field peas, rough winter peas and cowpeas; beans, such as velvet beans; kudzu; peanuts; and soybeans.

Plants of the grass family which are used in this invention may be any forage grass which occurs in a wild state or is cultivated. The forage grasses may be used directly or in the dried state as hay. Cereal grasses such as wheat, corn, oats, rye, barley and rice are included in this invention.

The invention contemplates the use of an entire plant, such as alfalfa hay; or a portion of a plant, such as peanut hulls, plant seeds or grains; or a derivative of a plant, such as rice bran or shelled corn.

The plant, portion or derivative is ground, for example using a commercial grinder for livestock feed. The particle size of the ground plant is not particularly important so long as it is capable of forming a paste material when mixed with water. For example, a particle size of a fine powder to a ¼ inch diameter is satisfactory. The chaff of a baler is useable.

After grinding, the plant material is mixed with water into a paste. No binder is needed in most cases, because the protein component of the plant material serves as a binder after heat treatment. Legumes are rich in protein and minerals essential for animal nutrients. They are commonly used to supplement grass forage, which are rich in carbohydrates.

A non-toxic degradable binder may be optionally included if the plant material selected is low in protein content.

A non-toxic filler may be optionally included, such as an inert dirt and/or sand material; grit such as coarse ground calcium; etc., to adjust the weight and frangibility of the target.

A further optional ingredient is a non-toxic coloring agent to color the target material.

The foregoing composition produces a target which may contain 100% plant material aside from residual moisture. Alternatively, the target of this invention may comprise other components such as the binder, filler and coloring agent described above, so long as the resulting target is mainly composed of the plant material, portion or derivative thereof and is degradable and edible by animals as forage. By the term "mainly composed of", we mean than the target contains more than 50% of the plant material.

The plant paste is packed into a mold having an inner space in the shape of the desired target. The interior of the mold may be coated with vegetable oil or other lubricant prior to inserting the plant paste therein to reduce sticking. The mold is closed and then heated until the plant paste hardens and has the desired frangibility.

It will be appreciated that for achieving desired factors of appearance, stability, cohesiveness, and frangibility, one skilled in the art will be capable of adjusting the proportions of ingredients, the granulation, the temperature of the molding powder, the press force, and the time of heating to determine a variety of conditions under which a suitable target may be produced.

The resulting target consists essentially of cellulose in a protein matrix. Protein denatured by the heat treatment acts to bind the cellulose by agglutination.

The target body may be painted or glazed with a conventional coating material to provide a desired color or texture, so long as the coating is non-toxic.

The target body may have the shape and thickness of a conventional shooting target for skeet, trap and the like. Generally, the target will be molded in the shape of a conventional target having a hollow dome-shape, weighing about 100 grams and having a diameter of 4¼ inches, as taught in the U.S. patents discussed in the section above entitled Description of Related Art. The disclosures of each such U.S. patent is incorporated by reference herein in this regard. Other conventional target shapes which are suitable for use in this invention include those of rabbit and bateau targets.

The targets of the present invention have essentially the same flight and frangible characteristics as does a conventional clay pigeon. The targets fly the same distance and time when thrown from a trap and break upon impact by pellets.

EXAMPLE 1

100 grams of ground dry plant matter is mixed with 80 grams of water to form a paste. The inside of the target mold is coated with vegetable oil and then the mold is packed with the plant paste. The mold is closed and heated at 225°–250° F. for 2 hours. After cooling, the target body is removed to obtain the hardened frangible target.

EXAMPLE 2

80 grams of ground dry plant matter is mixed with 20 grams of a dirt/sand mixture and 80 grams of water to form a paste. The inside of the target mold is coated with vegetable oil and then the mold is packed with the plant paste. The mold is closed and heated at 225°–250° F. for 2 hours. After cooling, the target body is removed to obtain the hardened frangible target.

It will be understood that the embodiments described herein are merely exemplary and that a person skilled in the art may make many variations and modifications without departing from the spirit and scope of the invention. All such modifications and variations are intended to be included within the scope of the invention as defined in the appended claims.

We claim:

1. A biodegradable frangible flying target adapted to be launched from a target launcher, comprising a frangible hardened body which consists essentially of a mixture of a non-toxic inert filler material and a non-toxic edible binder material, wherein said non-toxic inert filler material is selected from the group consisting of sand, dirt, grit and mixtures thereof, and wherein said non-toxic edible binder material is a legume plant which is an edible ground forage for an animal, or a portion of derivative of said legume plant, provided that said non-toxic edible binder material binds said inert filler material and said edible binder material to produce a frangible flying target without the addition of other binder materials.

2. The target according to claim 1, wherein said ground legume plant is at least one legume selected from the group consisting of alfalfa, beans, clovers, peas, kudzu, lespedeza, locust, lupine, peanuts, and vetch, or a mixture thereof.

3. The target according to claim 1, wherein said legume plant is alfalfa.

4. The target according to claim 1, wherein said legume plant is soybean.

5. The target according to claim 1, which further includes a non-toxic degradable coloring agent.

6. The target according to claim 1, which further includes a non-toxic exterior coating which covers said body.

7. The target according to claim 1, which is dome-shaped.

8. A process for manufacturing a biodegradable frangible flying target adapted to be launched from a target launcher, comprising a frangible hardened body which consists essentially of a mixture of a non-toxic inert filler material and a non-toxic edible binder material, wherein said non-toxic inert filler material is selected from the group consisting of sand, dirt, grit and mixtures thereof, and wherein said non-toxic edible binder material is a legume plant which is an edible ground forage for an animal, or a portion of derivative of said legume plant, provided that said non-toxic edible binder material binds said inert filler material and said edible binder material to produce a frangible flying target without the addition of other binder materials, said process comprising the steps of:

mixing said non-toxic inert filler material and non-toxic edible binder material with water into a paste, packing said paste into a mold having an interior space defining the shape of said target body to be manufactured, and heating said paste in said mold until hardened to obtain said target.

9. The process according to claim 8, wherein said legume plant is at least one legume selected from the group consisting of alfalfa, beans, clovers, peas, kudzu, lespedeza, locust, lupine, peanuts, and vetch, or a mixture thereof.

* * * * *